US005269207A

United States Patent [19]

Kutzler

[11] Patent Number: 5,269,207

[45] Date of Patent: Dec. 14, 1993

[54] SINGLE-HANDED LASHLESS REVERSIBLE SOCKET WRENCH

[76] Inventor: James W. Kutzler, 644 Beech Ave., Chula Vista, Calif. 91910-5305

[21] Appl. No.: 973,675

[22] Filed: Nov. 9, 1992

[51] Int. Cl.[5] ..... B25B 13/00

[52] U.S. Cl. ..... 81/59.1; 81/63.1; 192/44

[58] Field of Search ..... 81/59.1, 63.1; 192/44

[56] References Cited

U.S. PATENT DOCUMENTS

| | | | |
|---|---|---|---|
| 3,640,158 | 2/1972 | Myers | 192/44 X |
| 3,679,031 | 7/1972 | Stephens | 81/63.1 X |
| 3,824,625 | 7/1974 | Myers | 192/44 X |
| 4,457,416 | 7/1984 | Kutzler | 81/63.1 X |
| 4,669,339 | 6/1987 | Cartwright | 81/59.1 |

*Primary Examiner*—James G. Smith

*Attorney, Agent, or Firm*—Ralph S. Branscomb

[57] ABSTRACT

A drive mechanism which would ordinarily be used as a socket wrench drive mechanism utilizes internal roller bearings confined in ramp spaces which ramp in opposite directions between the internal socket wrench-mounting rotor and an external cylindrical chamber of the drive portion, such that when rotated in one direction, one set of the roller bearings ramps into wedged position in their ramp spaces to drive the rotor, and when rotated in the other direction, the other set of bearings is held clear of the wedge position so that the wrench free-wheels. This arrangement eliminates virtually all play or lash. Reversibility of the drive is established by a thumb-operated rocker which is rotatable between left-handed drive position and right-handed drive position.

2 Claims, 1 Drawing Sheet

SINGLE-HANDED LASHLESS REVERSIBLE SOCKET WRENCH

BACKGROUND OF THE INVENTION

The invention is an improvement of another invention patented by the same inventor on Jul. 3, 1984, under U.S. Pat. No. 4,457,416. That invention, entitled a "LASHLESS SOCKET DRIVE", utilized the roller bearing ramp-up drive mechanism to create the unidirectional and reversible, lashless drive of the instant invention. That wrench has been produced and works quite well.

The above-mentioned patented wrench is of the type that replaced reversible socket wrench drives characterized by pawl and ratchet drive mechanisms. Drives of this type are represented in U.S. Pat. Nos. 4,485,700, 4,512,218, and 4,631,988. The roller ramp-up mechanism, being somewhat more finely machined than the ratchet, virtually eliminates all lash or play inherent in the prior, ratchet-based systems. In a ratchet-based wrench, when working in confined spaces, there may not be enough space to move the wrench in the freewheel direction even far enough to engage the next ratchet tooth, making it impossible to use the wrench.

A substantially lashless drive utilized by applicant in his prior patent, on the other hand, will work in any space, no matter how confined, provided the wrench handle can move at all. For all practical purposes, there is no play or lash whatever. The roller bearings are pressed tightly into the converging ends of the ramp spaces in which they reside, and upon the handle being rotated in the drive direction, the drive immediately delivers torque to the rotor on which the sockets are mounted.

Other wrenches using the roller ramp-up mechanism have been developed. These wrenches basically fall into two categories. Both types require that the rollers seat in ramp spaces of which one side is circular or cylindrical (depending on whether ball or roller bearings are used), with the other surface being a ramp. The ramp provides the drive, and the cylindrical surface provides the freewheel.

The first type of wrench defines the cylindrical, freewheel surface on the rotor socket drive mechanism. The ramps are defined in the radially outer encasing housing, defined in the head of the wrench, which is connected to the handle.

It is easier to make a reverse mechanism for wrenches of this type, in which the inner rotor is cylindrical and the outer rotor chamber defines the ramps. Because the ramps are not rotational relative to the head and handle of the wrench, the ball or roller bearing reverse mechanism can be simply incorporated in the handle, and merely flipping a bearing keeper toggle mounted on the wrench head re-defines their position relative to the stationary ramps.

However, this type of wrench is not nearly as strong, nor does it provide the positive drive, as wrenches having the ramps on the internal rotor, with the outer chamber defining the cylindrical surface. The much smaller diameter of the cylindrical rotor surface compared to a cylindrical inner surface of the mounting chamber provides less gripping surface and is much easier to slip in the wrong direction should grease get on the cylindrical surface.

For this reason, the second type of bearing-based wrenches which reverses the positions of the ramps and the cylinder, having the ramps defined on the rotor and the cylindrical surface on the wrench head, is superior. However, an additional problem is encountered in that no longer can the reverse mechanism be stationary relative to the wrench. The reverse mechanism now must rotate with the rotor, because the rotor defines the ramps with respect to which the bearing orientation must be altered.

Applicant's first wrench fell into the second classification. The reverse mechanism in fact rotates with the drive rotor, and although the wrench works quite well, nonetheless generally a second hand is required in order to put the wrench into reverse drive. Another wrench in this second category is disclosed in the Pratt patent, issued May 10, 1949 under U.S. Pat. No. 2,469,572. Although this wrench has ramps on the rotor, the reversibility is accomplished by temporarily seizing up rotation of the bearing keeper or cage while the wrench is rotated, thus rotating the bearing keeper relative to the central rotor. With this type of mechanism, a single hand may be used to reverse the direction of the drive. However, the drawback of Pratt is that it incorporates a certain amount of play into the wrench as it is being reversed, inasmuch as the bearing keeper has gears or teeth which must be engaged by the arresting mechanism, and the wrench then turned to drive the bearings into the reversed position. A necessity therefore, reversal requires not only a dual motion, but necessarily causes play when reversing directions.

SUMMARY OF THE INVENTION

Applicant's new wrench, on the other hand, incorporates all of the advantages of the roller-type drive utilizing the inner ramps with the outer cylindrical surface, but is improved in that it has a thumb-operable reversing mechanism which will reverse the rotational drive direction of the wrench without any play whatsoever.

This is accomplished by means of a thumb-operable rocker detente having a pin which passes through the bearing keeper, and selectably engages in pin-receiving sockets in the rotor, to adjust the relative position of the keeper to the rotor, and thus the orientation of the internal bearings in their converging ramp spaces.

The original wrench of applicant has also been improved by eliminating the leaf springs which bias the bearings into their converging drive spaces, these springs having been replaced by coil springs for greater simplicity and durability.

DETAILED DESCRIPTION OF THE PREFERRED EMBODIMENT

Figures 1, 2, 3, 4, 5, 6, 7, 8, 9, 10:
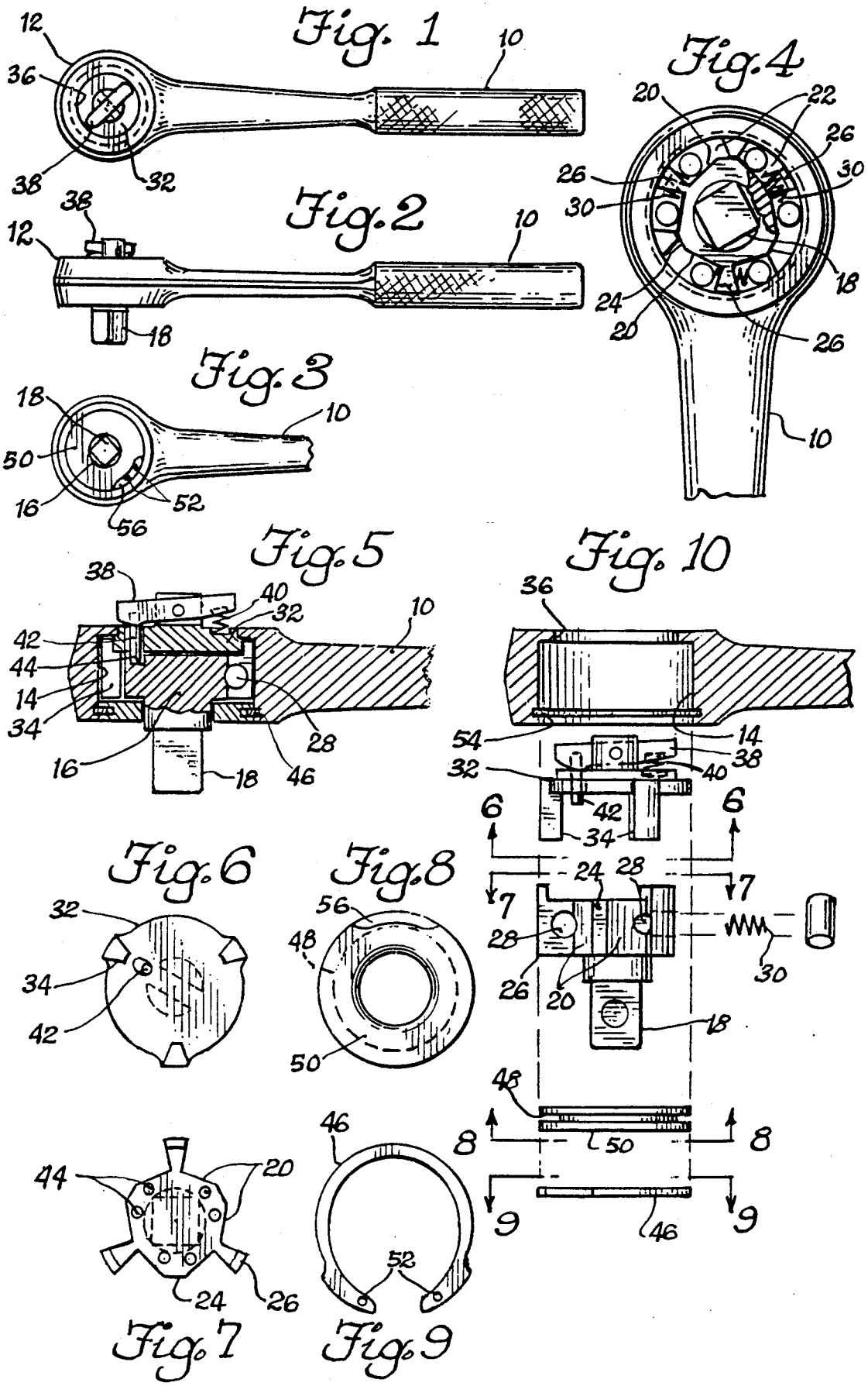
FIG. 1 is a rear elevation view of the wrench as it appears assembled.
FIG. 2 is a side elevation view of the wrench drive mechanism.
FIG. 3 is a front elevation view of the face of the wrench drive.
FIG. 4 is a front elevation view of the wrench drive similar to FIG. 3 but with the retainer plate removed to illustrate the bearing and keeper action.
FIG. 5 is a section taken longitudinally of the wrench.
FIG. 6 is a view taken along line 6—6 through the exploded elevation of FIG. 10.
FIG. 7 is a view taken across the exploded elevation view of FIG. 10 along the line 7—7.
FIG. 8 is a view taken along line 8—8 of the exploded elevation of FIG. 10.
FIG. 9 is a view taken along 9—9 of the exploded elevation of FIG. 10.
FIG. 10 is an exploded side elevation view of the internal mechanism of the drive.

The wrench has a handle 10 integral with a driving head 12, which defines a cylindrical internal chamber 14. This cylindrical chamber must be circular, but need not be cylindrical if ball bearing were used instead of roller bearings. It should be noted that throughout the description, clear modifications of the structure of the mechanism could be utilized to incorporate ball bearings rather than roller bearings.

Within the cylindrical chamber 14 is a rotor 16 with the externally extending drive lug 18 which engages the replaceable sockets of a typical socket wrench set. The rotor 16 defines ramps 20 that are spaced from the internal side wall of the cylindrical chamber 14 such that each ramp defines a ramp space 22, with these ramp spaces falling into ramp space pairs which meet at a vertex, or truncated vertex, 24. The ramp spaces converge toward the vertex.

The rotor also defines radially extending baffles 26, one of which passes between each of the bearings of adjacent bearing space pairs. Each of the baffles has an angularly extended bore 28 therethrough which houses a bearing bias coil spring 30 which loosely rests in the bore 28. The coil springs each bias the bearings on both sides of the respective baffle. Mounted atop the rotor when the wrench is assembled is a keeper 32 which has three fingers 34 which extend down between the bearings of each ramp space pair, generally aligning with the vertices. A circular opening 36 in the head 12 of the wrench provides access to the keeper, which has mounted to its top a pivotal rocker detente 38, best shown in FIG. 5. Rocker spring 40 pivots the rocker such that the detente pin 42 is biased against the top surface of the rotor, and snaps into any of the pin sockets 34 into which it comes into alignment.

As can be seen from FIG. 7, in the preferred embodiment there are three pairs of pin sockets, each pair corresponding to a counter-clockwise rotational position, and a clockwise rotational position of the keeper relative to the rotor, which in turn establish positive drive in the opposite direction from which the keeper is set.

All of the mechanism is retained inside the drive head by means of a retainer ring 46 which seats in the annular groove 48 of the face plate 50, with the retainer ring being compressed by a spanner wrench which engages the holes 52 to be inserted into the cylindrical chamber, expanding in the annular slot 54. There are no parts that spring apart when the wrench is disassembled, making it difficult to hold it all together to re-assemble. The parts are simply put into place, the retainer compressed to insert the face plate 50 into the head, and once the ring is released, it securely engages in the end with the directed retainer slot 54 to hold all the parts together. A cutaway 56 in the front edge of the fore plate provides access to the retainer ring for removal.

Although three ramps space pairs are illustrated, with six roller bearings which could be ball bearings, comparable designs with eight or ten or more roller bearings are conceivable. The roller bearings would have to approach needle bearings in such designs, which could have advantages and disadvantages over the larger roller bearings of the six-bearing unit illustrated.

Although a socket wrench drive is shown, the drive mechanism could be used for other purposes. The rotor could actually be the driving member, with the cylindrical chamber-defining member being the driven member. The unique direction-reversing action of the rocker enables the operator to reverse the direction of the wrench with one hand, rotating the keeper relative to the rotor, while the rotor is completely stationary. Once reversed, the lashless drive is established in the reverse direction, with there never having been any slippage or relative rotation of the wrench body relative to the rotor. Thus, the concept of lashless drive and one-handed drive reversal is incorporated in one unit.

It is hereby claimed:

1. A reversible drive mechanism comprising:

(a) a drive member;

(b) a driven member;

(c) one of said members defining a substantially cylindrical chamber with a circular wall and the other member having a rotor disposed internally of said chamber;

(d) said rotor defining ramps and having a plurality of radial baffles which define therebetween discreet ramp space pairs bounded on radially opposite sides by said chamber wall and said ramp;

(e) each of said ramp space pairs including two contiguous ramps meeting at a vertex to define oppositely converging ramp spaces;

(f) circular bearings captured in each ramp space and including bearing bias means for urging said bearings in the increasingly converging direction of the respective ramp spaces;

(g) a keeper having a finger for each vertex and passing down into the respective ramp space pairs, said keeper being adjustably rotatable relative to said rotor to define at least one counterclockwise position and at least one clockwise position relative to said rotor such that in each of said positions the bearings in one ramp space of each ramp space pair is held away from the converging end of the respective ramp space, permitting the other bearings in the other bearing spaces to wedge into the respective ramp space on rotation of said rotor relative to said chamber to define one rotational drive direction and the other rotational direction being freewheeling;

(h) detente means accessible externally of said drive means to releasably establish said keeper selectively in said counterclockwise position or in said clockwise position; and, (i) detente means comprises a spring-biased rocker defined on said keeper and having a detente pin passing through said keeper and biased against said rotor, and said rotor defining at least two pin sockets into which said pin will alternatively snap upon mutual rotation of said keeper with said rotor aligning said pin with the respective pin socket.

2. Structure according to claim 1 wherein said pin sockets are 6 in number and provided as radially spaced pairs to enable said rocker to be assembled in any possible orientation relative to said keeper without disabling the rocker.

* * * * *